US005157870A

United States Patent [19]

Pike

[11] Patent Number: 5,157,870

[45] Date of Patent: Oct. 27, 1992

[54] PRECISION CLAMP SCISSORS SHARPENING SYSTEM

[76] Inventor: Arthur E. Pike, 66 Crystal Rock Ct., Middle Island, N.Y. 11953

[21] Appl. No.: 653,008

[22] Filed: Feb. 8, 1991

[51] Int. Cl.[5] ..... B24B 3/52; B24B 3/60

[52] U.S. Cl. ..... 51/122; 51/218 R; 51/221 BS; 51/224; 51/231; 269/45; 269/262

[58] Field of Search ..... 51/121, 122, 125, 125.5, 51/216 A, 216 R, 216 ND, 216 H, 217 R, 217 A, 217 S, 218 R, 218 A, 221 BS, 224, 230, 231, 233, 234, 285, 226, 221 R; 269/45, 262

[56] References Cited

U.S. PATENT DOCUMENTS

| | | | |
|---|---|---|---|
| 526,571 | 9/1894 | Gosling | 51/220 |
| 2,578,309 | 12/1951 | Kroczek | 51/220 |
| 2,762,175 | 9/1956 | Kramer | 51/285 |
| 2,797,534 | 7/1957 | Rouse | 51/122 |
| 2,829,473 | 4/1958 | Pruner | 51/220 |
| 3,818,641 | 6/1974 | Long | 51/125.5 |
| 3,863,395 | 2/1975 | Brown | 51/121 |
| 4,504,283 | 3/1985 | Charvat | 51/285 X |
| 4,528,778 | 7/1985 | Wolff . | |
| 4,748,775 | 6/1988 | Imahashi | 51/218 R X |

FOREIGN PATENT DOCUMENTS

| | | | |
|---|---|---|---|
| 470714 | 8/1937 | United Kingdom | 51/220 |

*Primary Examiner*—Bruce M. Kisliuk
*Assistant Examiner*—John A. Marlott
*Attorney, Agent, or Firm*—Alfred Walker

[57] ABSTRACT

A precision clamp scissors sharpening system which consists of a fittably adjustable clamping device attached by means of a support bar to a spring-loaded pin level and adjustable bar to a sliding bar on top of a housing unit wherein is situated a means for regulating the velocity of the rotation of a circular sharpening disc which performs the function of sharpening scissor and/or other blade edges held in the clamp device by means of adjustable pieces which set the blade edge at a degree setting desired by the user and which clamp device may be extended for use with large circular sharpening discs or replaced with one designed for the sharpening of cuticle nippers and/or the inside parts of other blades.

2 Claims, 3 Drawing Sheets

PRECISION CLAMP SCISSORS SHARPENING SYSTEM

BACKGROUND OF THE INVENTION

The present invention relates to a precision clamp scissors sharpening system. It is designed to provide a sophisticated means of sharpening the edges of scissor blades by means of a clamping device which is fittably adjusted onto the surface of a circular sharpening disc mounted on a unit which regulates the velocity of its rotation for purposes of sharpening said scissor edge.

Devices which relate to the sharpening of knives, scissors and other cutting instruments are generally known in the art. However, none of the existing art provides a means for the exclusive sharpening of scissors by means of a rotational system with a fittably adjustable clamp.

SUMMARY OF THE INVENTION

Accordingly, it is an object of the present invention to provide a precision clamp scissors sharpening system by the use of a fittably adjustable clamping device which holds a scissor edge of any length or width to be sharpened on the surface of circular sharpening disc which lies atop the body of the unit wherein is contained the method of varying the velocity of the rotation of said circular sharpening disc.

Furthermore, it is an object of the present invention to provide an adjustable support bar which extends slidably outward from the top of the unit to facilitate variations in the setting of the clamp device, which holds the scissor in place against the surface of the circular sharpening disc. The adjustable support bar also accomplishes the purpose of providing for the level and stable situation of the clamp device when in use.

More particularly, it is an object of the present invention to provide a precision clamp scissors sharpening system by means of a sophisticated interlocking of movable and adjustable pieces which permits the easy, expeditious and accurate sharpening of a scissor edge to exact user specifications for a given task of sharpening. This is accomplished by mounting a circular sharpening disc atop a geometrically shaped housing unit in which is contained the means by which said circular sharpening disc is rotated to effect the sharpening of a scissor edge. A clamp device consisting of a level, support bar, pin handle, increment bar, lever and support spring is attached to an adjustable support bar which fits into a slide bar on top of said housing unit.

Another object of the present invention is to permit the level, stable and scientific sharpening of a scissor edge by the use of a spring-loaded pin which protects the user from unintentional contact with the scissor edge. The spring-loaded pin is situated in such a manner in and around the clamp device that the process of sharpening a scissor edge is contingent upon manual pressure being applied by the user upon the clamp assembly. User release of said pressure automatically lifts the scissor away from the surface of the circular sharpening disc and away from the user.

In keeping with these objects and with others which will become apparent hereinafter, one feature of the present invention resides, briefly stated, in a precision clamp scissors sharpening device which consists of a housing unit upon which is situated a disposable, rotating circular sharpening disc controlled by counterclockwise button on the exterior of said housing unit. A scissor edge is placed into a clamp device, which clamp device consists of nuts, support bars, a level, a spring-loaded pin, a lever, and an adjustable support bar, which clamp assembly fits into the top of a slide bar located on the top of the housing unit near one end of the circular sharpening disc.

The novel features which are considered as characteristic for the invention are set forth in particular in the appended claims. The invention itself, however, both as to its construction and its method of operation, together with additional objects and advantages thereof, will be best understood from the following description of its specific embodiment when read in connection with the accompanying drawings.

DESCRIPTION OF PREFERRED EMBODIMENT

Figure 1:
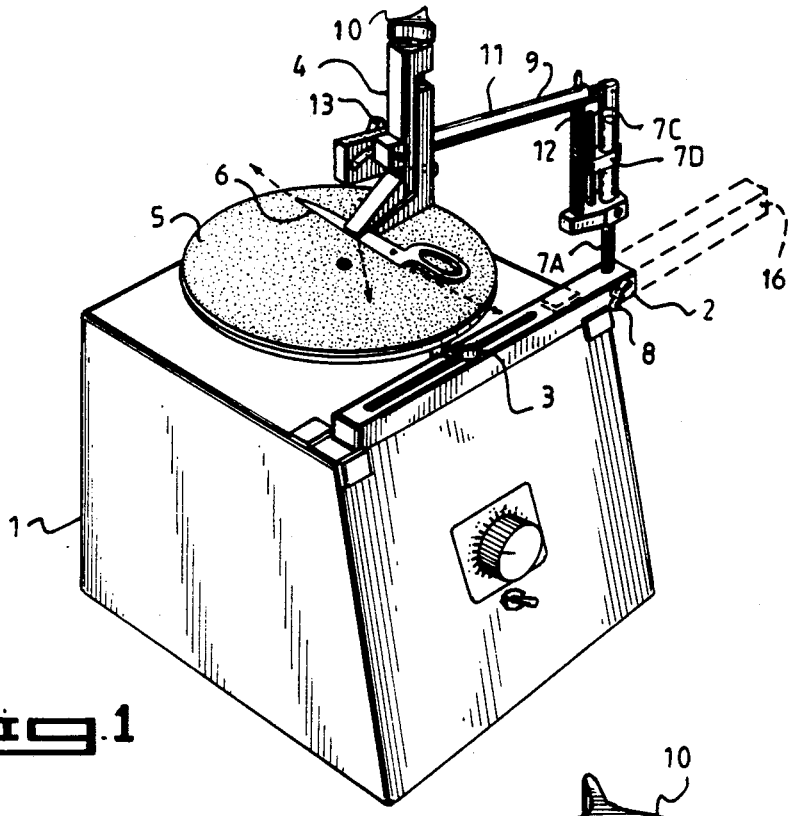
FIG. 1 is a perspective view of the precision clamp scissors sharpening device.

As shown in FIGS. 1, 2, 3, 5, 6 and 7, a precision clamp scissors sharpening system has a housing unit 1 upon which is located slide bar 2 and wing nut 3 which control the operation of the system. The scissors 6 to be sharpened is held within clamp 4. The proper aligning position for clamp 4 is holding mechanism comprising horizontal support bar 9 for clamp 4, vertical adjustable bar 7, including a first lower vertical bar 7A slidable within a hollow conduit, within hollow upper vertical extension 7B horizontal base slide bar 2, within which vertical adjustable support bar 7 is also vertically slidable, spring loaded pin lever 12 between support bar 9 and hollow upper vertical extension member 7B joinable to lower vertical bar 7A. When slide bar 2 is extended in an outward position, a scissor edge is placed into clamp 4 which can be set a degree setting of between zero degrees and sixty-five degrees for purposes of being sharpened by the rotation of circular disc 5 (most scissors range in settings from twenty-five to thirty degrees for maximal use of the sharpening disc 5). Once scissor edge 6 is placed at the desired setting, adjustable bar 7, which is vertically adjustable within slide bar 2 at the lower end of adjustable bar 7, is adjusted by wing nut 8 to assure that the clamp 4 holding bar 9 is level straight across to assure a true edge for the scissor edge undergoing the sharpening process when the scissors blade within clamp 4 is in contact with the surface of the circular disc 5 at the setting of zero degrees. This assures that the degree setting selected for the clamp 4 is the same one that will be found for the sharpening of scissor edge 6 as said scissor edge is "trued" from the circular disc 5. Scissor edge 6 is locked into clamp 4 by means of a handle 10.

In the preferred embodiment, the sharpening disc comprises a magnetic support plate beneath a separate removable metal sharpening disc.

Level 11 is attached to clamp 4 to indicate to users that the setting is true and accurate to that which has been selected and that a level surface setting is locked in place. The spring-loaded pin lever 12, including pin 12A and spring 12B is attached to the adjustable vertical bar 7 to regulate the pressure which is applied manually onto the clamp during the process of sharpening scissor edge 6. The spring-loaded pin lever 12 also secures the safety of the user as the release of pressure upon clamp 4 automatically releases scissor edge 6 from circular sharpening disc 5 in a manner which does not threaten the user.

Figure 7:
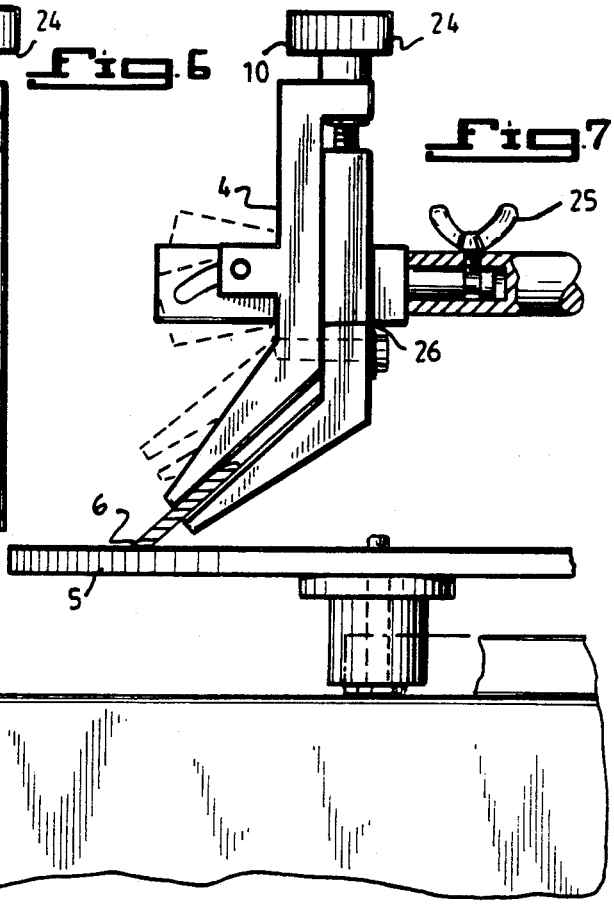
FIG. 7 is a close-up side elevation view of the clamping assembly portion of the device as shown in FIG. 1.

The secondary wing nut 13 holds the clamp 4 in place at a stationery ninety degrees which gives the control of maintaining a zero degree surface from the top to the bottom of the scissor. As shown in FIGS. 1 and 7, the wing nut 13 can be adjusted to the desires of the user to rotate the clamp 4 off of a vertical alignment, so that jaws 4A and 4B of clamp 4 rotate from zero to eighty degrees off a vertical alignment.

The clamp device 4, support bar 9 and adjustable support bar 7, can be adjusted by the extension of the slide bar 2 for the comfort of users who are left-handed.

The vertical axis of clamp 4 generally is set at ninety degrees to the surface of sharpening disc 5 while the claw part, namely claws 4A and 4B are set at forty-five degrees.

The entire surface of blade 6 is applied to the surface of the sharpening disc 5, thereby allowing for an even sharpening of the entire blade, as opposed to sharpening incrementally against the limited circumferential edge surface of conventional upright discs.

Figure 2:
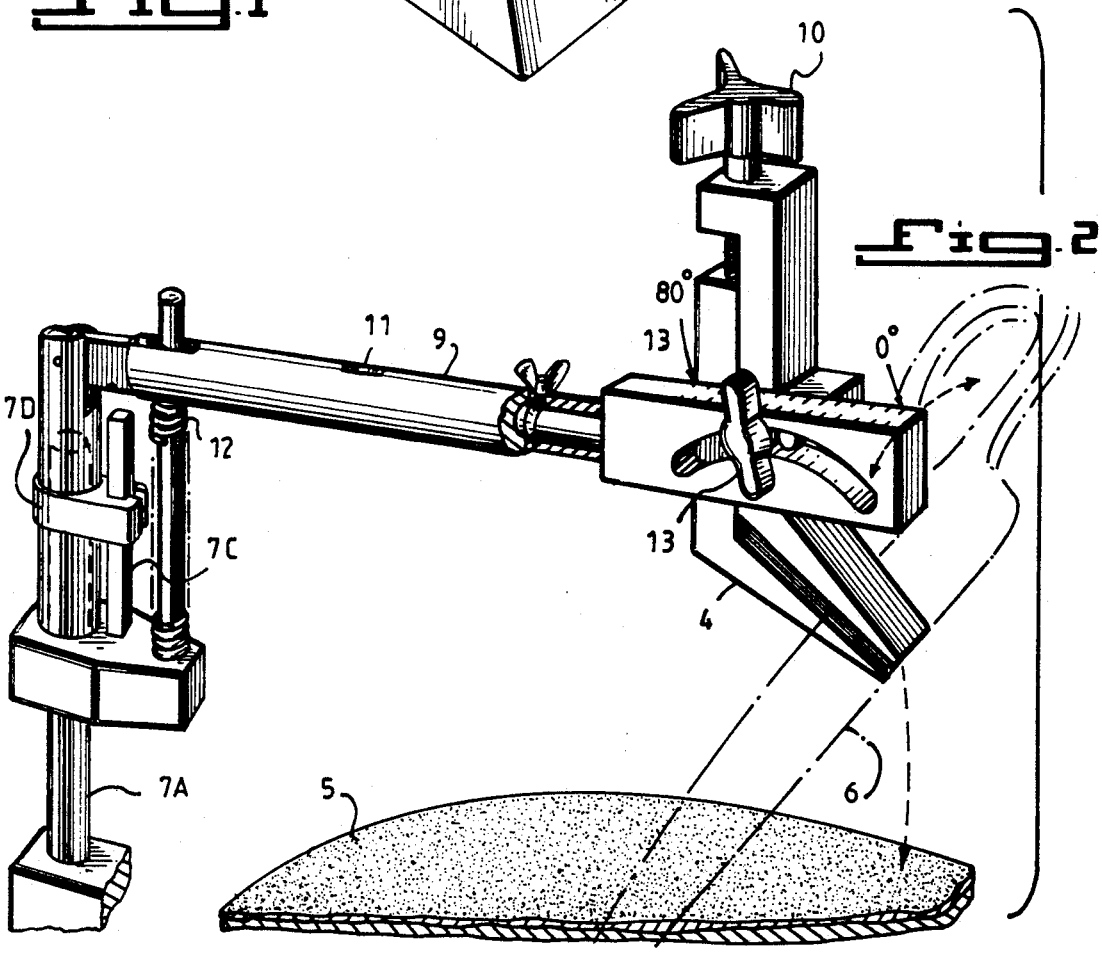
FIG. 2 is a close-up view of clamping assembly and its attachments as shown in FIG. 1.

As seen in FIG. 1, the machine is shown with circular disc 5 and clamp device 4 situated above said circular disc 5 with the slide bar 2 in a closed position in solid coloration, and in an open position by use of broken lines 16 for the adjustment of clamp device 4 according to user specifications and desires. Wing nut 3 in the center of slide bar 2 controls the length of said slide bar for the positioning of clamp device 4. As shown in FIGS. 2 and 7, the wing nut 13 within arcuate opening 13A of clamp holding member 13B permits the variable rotatable adjustments of clamp device 4 for sharpening assignments that do not use the settings mentioned above.

As seen in FIG. 2, there is shown the opposite side of clamp 4 and the method by which wing nut 13 permits the setting of the desired degree of sharpening within the parameters having the jaw part 4A and 4B of clamp 4 from of zero to eighty degrees. This facilitates adjustments for scissors of different lengths and widths. Clamp 4 is locked at a consistent ninety degrees vertical by the use of the clockwise motion of adjustable nut 13 within arcuate opening 13A of clamp holding member 13B to facilitate the stabilization of the degree setting selected by the positioning of wing nut 13. Also shown is level determining means 11, such as a bubble level measurer in the center of support bar 14, which itself is connected to spring-loaded pin lever 12.

As further shown in FIG. 2 on, optional zero gravity vertical stop lock bar 7C, swivelable about upper hollow vertical extension lever 7B by means of rotatable clamp 7D, may be provided to prevent horizontal support bar 9 from deviating downward off of the desired horizontal alignment. It, however, does not prevent manual upward adjustment of support bar 9. If, however, one desires to lower the scissors blade 6 within the clamp 4 to take off larger amounts of metal (rather than close sharpening of blade 6), then vertical stop lock bar 7C can be swiveled 180 degrees by means of rotatable clamp 7D which clamp is rotatable over upper hollow extension member 7B to remove the stop lock bar 7C away from underneath support bar 9.

Figure 3:
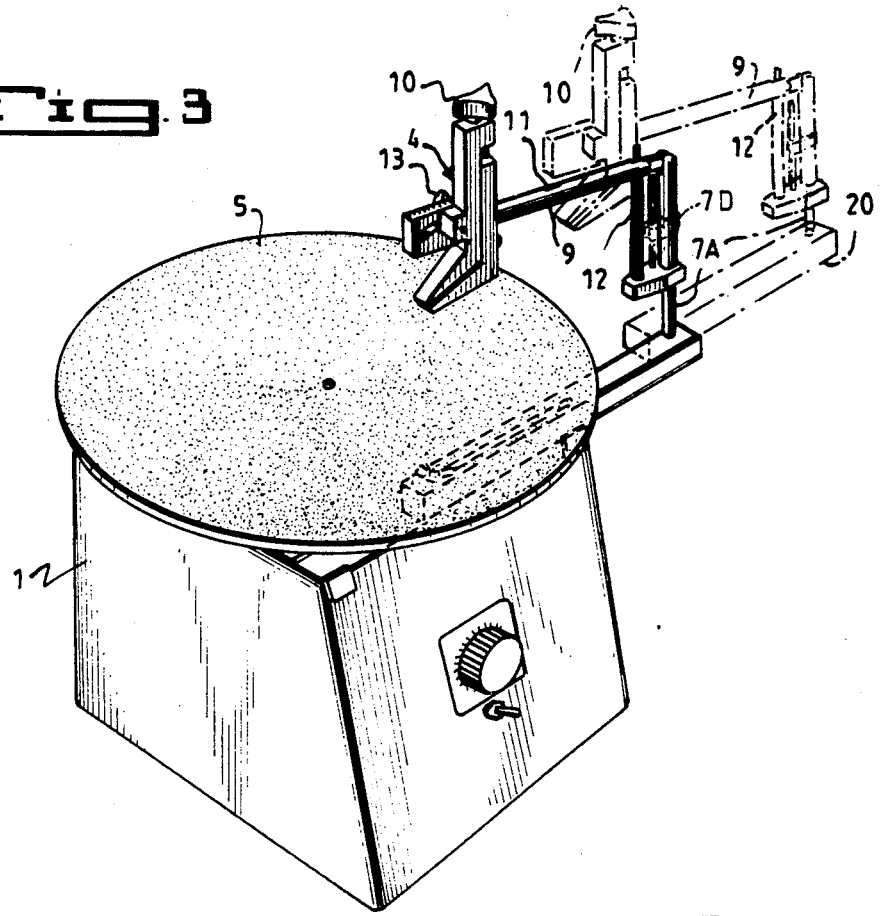
FIG. 3 is a perspective view of the device shown in FIG. 1 in two different settings by means of the adjustable slide bar.

As seen in FIG. 3, there is shown the clamp device 4 in a position of total extension in dotted lines, by means of a "piggy-back" further extension bar 20 which may be added for purposes of a longer extension with a larger sharpening disc or with a longer blade of scissors for sharpening of same. The disposable, circular sharpening disc 5 may generally range in diameter from five to twelve inches; the addition of extension bar 20 affords a user the option of a sharpening disc twelve inches in diameter or larger.

Figure 4:
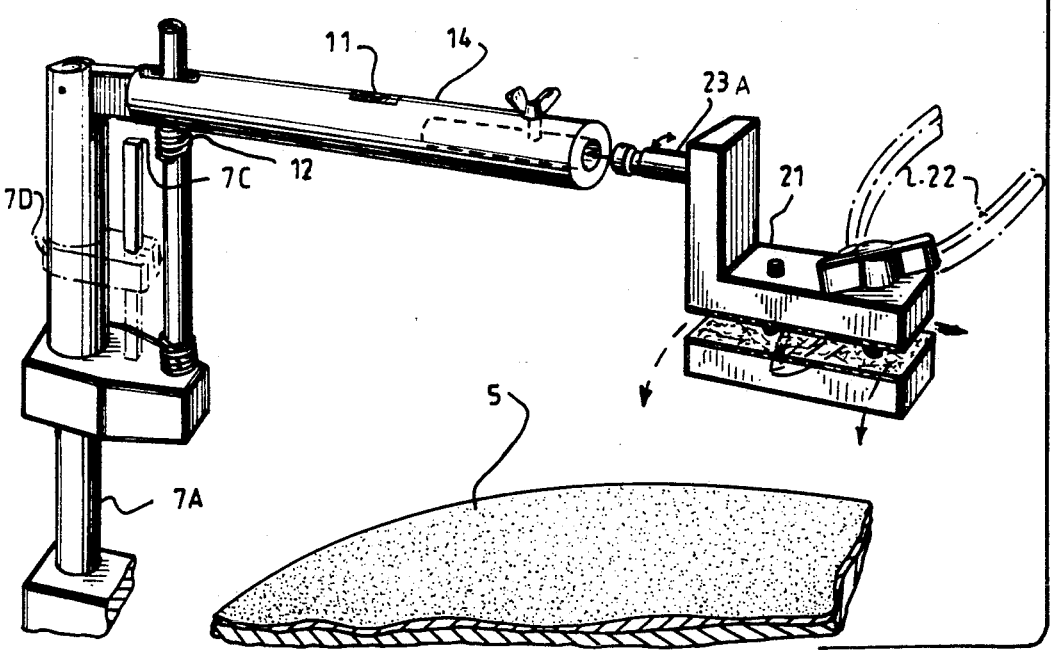
FIG. 4 is a close-up view of the device with an alternate clamp assembly for cuticle nippers.
Figure 5:
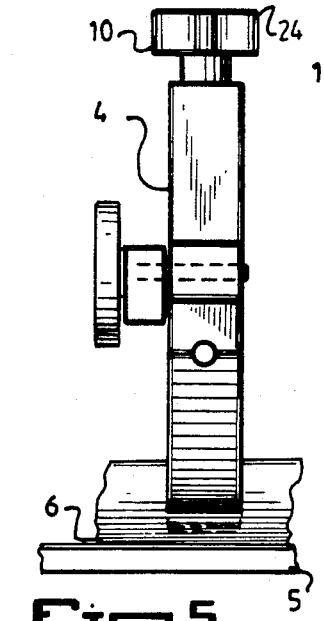
FIG. 5 is a front elevation view of the clamp assembly portion of the device as shown in FIG. 1.
Figure 9:
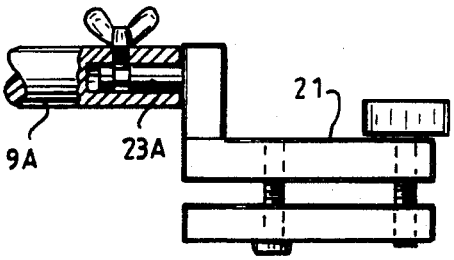
FIG. 9 is a front elevation view of the cuticle nipper sharpening embodiment of the device as shown in FIG. 4.
Figure 10:
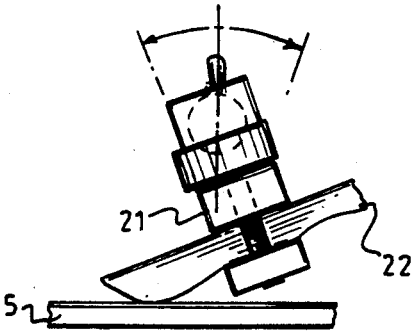
FIG. 10 is a side elevational view of the cuticle nipper sharpening embodiment of the device as shown in FIG. 4, showing its ability to tilt up or down according to user needs.

In an alternate embodiment, as seen in FIGS. 4, 9 and 10, horizontal support bar 14 is shown with an alternate clamp device 21 designed for purposes of sharpening the inside rise of a scissor blade as well as to be used for the sharpening of an instrument known as a cuticle nipper 22, shown here in dotted lines as it would be placed into the clamp device 21. This permits the flat surfacing of the instrument edge upon circular sharpening disc 5 for the purpose of the desired sharpening. Swivel bar 23 permits clamp device 4 to be rotatably moved from side to side or to be locked in a particular position at the discretion of the user, and also facilitates the removal of the clamp device at an angle upwards of one hundred eighty degrees away from the surface of circular disc 5 to permit the removal and replacement of the circular disc.

As seen in the preferred embodiment shown in FIGS. 1, 2, 3, 5, 6 and 7 the front part of clamp device 4 is shown with respect to its orientation orientation to the surface of circular disc 5.

Figure 6:
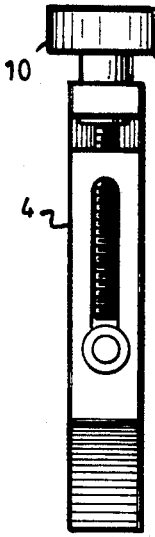
FIG. 6 is a close-up rear elevation view of the clamp assembly portion of the device as shown in FIG. 1.

As seen in FIG. 6, the back part of clamp device 4 is shown with rotatable handle 10 which allows clamp assembly 4 to slide up and down and to operate as a vise system for the sharpening of scissor edges on the surface of circular disc 5.

As seen in FIG. 7, a side-view of the device demonstrates how clamp device 4 is placed in various settings and can be moved from side to side to facilitate the demands of user specifications. In general locking piece 25 keeps clamp device 4 stationary in relation to circular disc 5 while the seam 26 of clamp device 4 is set at ninety degrees and jaws 4A and 4B of clamp 4 hold scissor edge 6 at a forty-five degree angle to maximize the sharpening of said scissor edge. As shown in FIG. 2, the possible arcs of setting the clamp assembly 4 in place by wing nut 13 are from zero degrees in a further embodiment described to eighty degrees to facilitate the desired setting of the scissor edge 6 in clamp 4 at a desirable angle to circular sharpening disc 5.

Figure 8:
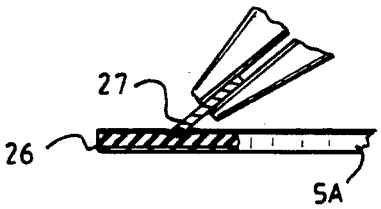
FIG. 8 is a close-up cut-away view of the device with an alternate sharpening disc specifically to receive a convex-edge blade.

As seen in FIG. 8, there is shown another circular sharpening disc 5A, which is designed to sharpen convex edge blades. The disc, which has pliable support means 28 beneath the cutting surface, fits on the surface of the housing unit and accepts the convex edge blade 27 and takes the shape of said convex edge blade as the sharpening surface 5A beneath pliable support means 28 is indented responsive according to the surface of the convex edge blade. No other existing system has such a method of sharpening convex edge blades without a computerized-guided methodology.

As seen in FIGS. 9 and 10, the alternate nipper clamp assembly 21 is shown in its position with the desired effect being an ability to serve as a vise for the sharpening of scissor edges. The clamp may be moved adjustably either left or right depending upon the angle of the nipper being sharpened. The nipper clamp device has a rotatable clamp internal support member 23A rotating within support bar 14 for rotating the alternate clamp assembly 21 left or right off of a vertical axis to accomplish tipping of the nipper blade.

As seen in FIG. 10, the alternate cuticle nipper clamping assembly 21 is shown with its ability to tip up or down depending upon user demands.

As a method of operation, generally the scissors blade 6 is positioned within clamp 4. The appropriate sharpening angle for the scissors blade 6 with respect to the horizontal rotating sharpening disc 5 disc is measured and determined with respect to the horizontal surface of disc 5 and an imaginary vertical axis of clamp 4. The scissors blade is then biased by downward force against countervailing force from a spring lever 12 against the rotating surface of disc 5 until the appropriate sharpening is accomplished.

When a cuticle scissors blade 22 with a convex curvature 27 of the blade 22 in profile is used, a movable clamp 4A holds the scissors while downward force is applied against the disc 5A and pliable support means 26 beneath said disc 5A such that disc 5A and pliable support means 26 indent responsive to the curvature 27 of convex blade 22, until the appropriate sharpening is accomplished.

While the illustrated embodiment herein has been set forth as aforesaid, it is understood that various versions may be made without departing from the scope of this invention.

We claim:

1. A precision clamp scissors blade sharpening device which comprises:

a housing unit on the top of which housing is situated a circular sharpening disc which disc is rotated by a rotational unit operated by a rotator from said housing unit, p1 said sharpening disc having a planar sharpening surface, a clamping device for clamping a scissors blade, which clamping device is fittably adjusted to effect the sharpening of an entire cutting surface edge of said scissor blade, means for simultaneously applying the entire surface of said blade to said sharpening disc, said means for simultaneously applying the entire surface of said blade to said sharpening disc includes said clamping device for clamping scissors blades, said clamping device being fittably adjusted by means of interlocking clamp jaw pieces and said clamping device being movable toward the planar surface of said sharpening disc such that the entire lengthwise surface of said blade to be sharpened is simultaneously applied to said surface of said rotating sharpening disc, a horizontal slide bar extending in an outward position at the base of said circular sharpening disc and to which horizontal slide bar is attached an adjustable vertical support bar which adjustable vertical support bar connects to a further horizontal support bar, a spring-loaded support pin lever between said adjustable vertical support bar and said further horizontal support bar, said further horizontal support bar movable in a vertical axis about said adjustable vertical support bar, said clamping device holding said scissors' blade, said clamping device being movable downward towards said sharpening disc wherein said planar surface of said disc is perpendicular to a rotational axis of said sharpening disc, a movable zero gravity vertical stop lock means to stop a downward movement of said further horizontal support bar and said clamp below a predetermined horizontal level, said horizontal level having a predetermined vertical height above said sharpening disc, said movable zero gravity stop lock means permitting upward movement of said further horizontal support bar and said clamp above said predetermined horizontal level, said movable zero gravity stop lock bar means including a vertical member having a top, a bottom and a vertically extending portion, said top of said vertical member having a vertical height extending to said predetermined horizontal level, said top of said vertical member engageable with said further horizontal support bar to stop said movement of said further horizontal support bar about said adjustable vertical support bar within said vertical height above said sharpening disc.

2. The device of claim 1, wherein said adjustable vertical support bar includes a first lower vertical bar, a second upper hollow vertical bar, said first lower vertical bar slidable within said second upper hollow vertical bar, said first lower vertical bar joinable to said horizontal slide bar by a fastening means, said vertical member of said zero gravity vertical stop lock means being rotatable about said second upper hollow vertical bar by means of a rotatable clamp, which said rotatable clamp is rotatable about said second upper hollow vertical bar to rotate said vertical member of said zero gravity vertical stop lock means away from said vertical axis of said adjustable horizontal support bar to permit said further horizontal support bar to optionally move downward within said vertical axis below said predetermined horizontal level, said further horizontal support bar including a first hollow horizontal member and a second slidable horizontal member, said second slidable horizontal member slidable within said first hollow horizontal member and fixable within said first hollow horizontal member by a fastening means, said second slidable horizontal member rotatable within said first hollow horizontal member to permit the rotation of said clamp about a first horizontal axis of said second hollow horizontal member, said clamp further rotatable off a second horizontal axis perpendicular to said first horizontal axis by means of a fastening means of said clamp to said second slidable horizontal member, said clamp including a pair o f jaw parts, said jaw parts being movable arcuately from zero to eighty degrees off a vertical axis.

* * * * *